US005606807A

United States Patent [19]

Prepodnik

[11] Patent Number: 5,606,807

[45] Date of Patent: Mar. 4, 1997

[54] DISPOSABLE SHOWER THONG

[76] Inventor: Ronald W. Prepodnik, 8 S. Locust Ave., Medford, N.Y. 11763

[21] Appl. No.: 578,356

[22] Filed: Dec. 26, 1995

[51] Int. Cl.[6] ..... A43B 5/08; A43B 1/06; A43B 3/12

[52] U.S. Cl. ..... 36/8.1; 36/11.5; 36/9 A; 36/86

[58] Field of Search ..... 36/8.1, 11.5, 9 A, 36/98, 84, 86

[56] References Cited

U.S. PATENT DOCUMENTS

| | | | |
|---|---|---|---|
| 1,522,890 | 1/1925 | Krap | 36/9 A |
| 1,544,578 | 7/1925 | Henderson | 36/11.5 |
| 2,220,722 | 11/1940 | Langfelder | 36/9 A |
| 3,874,100 | 4/1975 | Schwitters | 36/9 A X |
| 5,165,183 | 11/1992 | Huang | 36/11.5 |

*Primary Examiner*—Ted Kavanaugh

[57] ABSTRACT

A disposable shower thong including a sole member formed of a flat planar paper material that has a top surface and a bottom surface. The paper material of the sole member has a top layer and a bottom layer with a common sheeting therebetween. Each layer is comprised of a corrugated paper sheet. The corrugated sheet of each layer has an alternating sequence of protruding crests and recessed troughs defining a wave-like filler. The sole member has a front foot section, a heel section and an end step section. Lastly, an elongated strap is positioned around the sole member and attached by an adhesive to the bottom surface of the sole. The strap, when attached to the bottom surface, forms a semi-spherical loop about the top surface of the sole.

7 Claims, 3 Drawing Sheets

DISPOSABLE SHOWER THONG

BACKGROUND OF THE INVENTION

1. Field of the Invention

The present invention relates to a disposable shower thong and more particularly pertains to providing a shower thong that is formed from a waterproof corrugated paperboard that has been impregnated with anti-fungal agents.

2. Description of the Prior Art

The use of a disposable slipper is known in the prior art. More specifically, disposable slippers heretofore devised and utilized for the purpose of foot wear are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,165,183 to Huang discloses a disposable biodegradable sanitary sandal. U.S. Pat. No. 4,751,784 to Petker and Sundgaard discloses a disposable slipper and method for forming the same. U.S. Pat. No. 4,112,599 to Krippelz discloses a method of cushioning and ventilating a foot, and foot wear including disposable slippers and insoles for practicing such method. U.S. Pat. No. 3,871,116 to Vanderlinden discloses an antiseptic disposable mule or slipper. Lastly, U.S. Pat. No. 3,775,873 to Small discloses a disposable plastic slipper.

While these devices fulfill their respective, particular objectives and requirements, the aforementioned patents do not describe a disposable shower thong that allows the use of disposable thongs in public and private showers, wherein the thongs are corrugated paper covered with waterproofing material and impregnated with anti-fungal material.

In this respect, the disposable shower thong according to the present invention substantially departs from the conventional concepts and designs of the prior art, and in doing so provides an apparatus primarily developed for the purpose of providing a shower thong that is formed from a waterproof corrugated paperboard that has been impregnated with anti-fungal agents.

Therefore, it can be appreciated that there exists a continuing need for a new and improved disposable shower thong which can be used for providing a shower thong that is formed from a waterproof corrugated paperboard that has been impregnated with anti-fungal agents. In this regard, the present invention substantially fulfills this need.

SUMMARY OF THE INVENTION

In view of the foregoing disadvantages inherent in the known types of a disposable slippers now present in the prior art, the present invention provides an improved disposable shower thong. As such, the general purpose of the present invention, which will be described subsequently in greater detail, is to provide a new and improved disposable shower thong and method which has all the advantages of the prior art and none of the disadvantages.

To attain this, the present invention essentially comprises a sole member that has a front foot section, a heel section and an instep section. The sole is formed of a flat planar paper material that has a top surface and a bottom surface. Each surface of the sole has been coated with a water resistant material to make the paper material of the sole member waterproof. Each surface of the sole has been impregnated with an anti-fungal agent. The paper material of the sole member has a top layer and a bottom layer with a common sheeting. Each layer is comprise of a corrugated paper sheet. The corrugated paper sheet of the top layer is attached to an upper surface of the common sheeting and the top surface of the sole. The corrugated paper sheet of the bottom layer is attached to a bottom surface of the common sheeting and the bottom surface of the sole. The corrugated sheet of each layer has an alternating sequence of protruding crests and recessed troughs that define a wave-like filler. The crests and troughs of each corrugated sheet of each layer extends laterally to the left and right edges of the sole. The crests and troughs are in a direction that is generally perpendicular with the longitudinal axis of the sole member. The filler of each layer is treated with the water resistant material for making the filler of each layer waterproof. Lastly, an elongated strap is formed of a double layer of flexible material. The layers of the strap are attached to each other by an adhesive. The strap is positionable around the sole member and forms a semi-circular loop that is positioned above the top surface of the sole. The strap is attached by an adhesive to the bottom surface of the sole between the instep section and the front foot section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved disposable shower thong which has all of the advantages of the prior art a disposable slipper and none of the disadvantages.

It is another object of the present invention to provide a new and improved disposable shower thong which may be easily and efficiently manufactured and marketed.

It is further object of the present invention to provide a new and improved disposable shower thong which is of durable and reliable constructions.

An even further object of the present invention is to provide a new and improved disposable shower thong which is susceptible of a low cost of manufacture with regard to both materials and labor, and which accordingly is then susceptible of low prices of sale to the consuming public, thereby making such disposable shower thong economically available to the buying public.

Still yet another object of the present invention is to provide a new and improved disposable shower thong which provides in the apparatuses and methods of the prior art some of the advantages thereof, while simultaneously overcoming some of the disadvantages normally associated therewith.

Even still another object of the present invention is to provide a disposable shower thong for providing a shower thong that is formed from a waterproof corrugated paperboard that has been impregnated with anti-fungal agents.

Lastly, it is an object of the present invention to provide a new and improved disposable shower thong including a sole member formed of a flat planar paper material that has a top surface and a bottom surface. The paper material of the sole member has a top layer and a bottom layer with a common sheeting therebetween. Each layer is comprised of a corrugated paper sheet. The corrugated sheet of each layer has an alternating sequence of protruding crests and recessed troughs define a wave-like filler. The sole member has a front foot section, a heel section and an end step section. Lastly, an elongated strap is positioned around the sole member and attached by an adhesive to the bottom surface of the sole. The strap, when attached to the bottom surface forms a semi-spherical loop about the top surface of the sole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
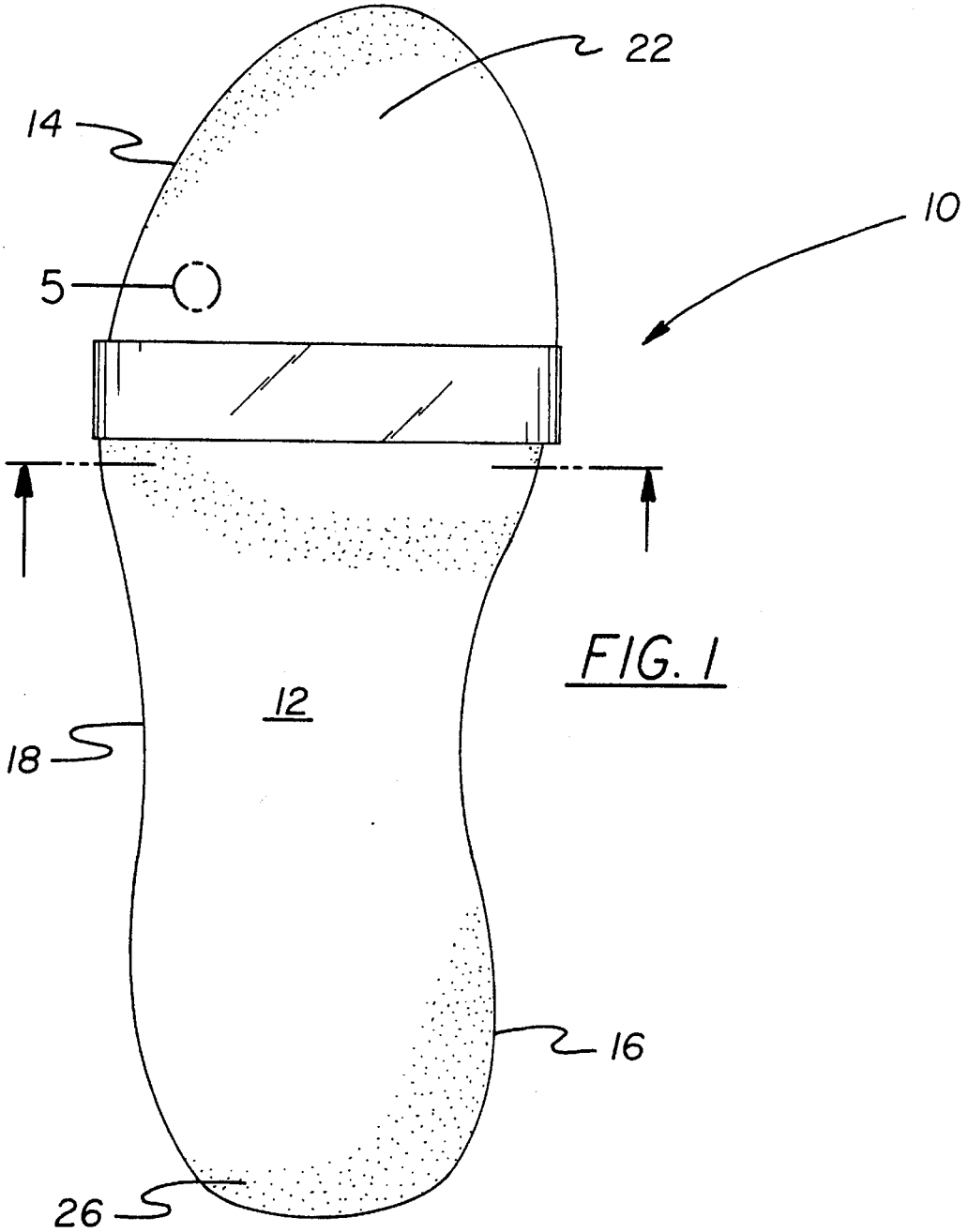
FIG. 1 is a perspective view of the preferred embodiment of the disposable shower thong constructed in accordance with the principles of the present invention.

With reference now to the drawings, and in particular to FIG. 1 thereof, the preferred embodiment of the new and improved disposable shower thong embodying the principles and concepts of the present invention and generally designated by the reference numeral 10 will be described.

The present invention, the disposable shower thong 10 is comprised of a plurality of components. Such components in their broadest context include a sole member and a strap. Such components are individually configured and correlated with respect to each other so as to attain the desired objective.

Figure 3:
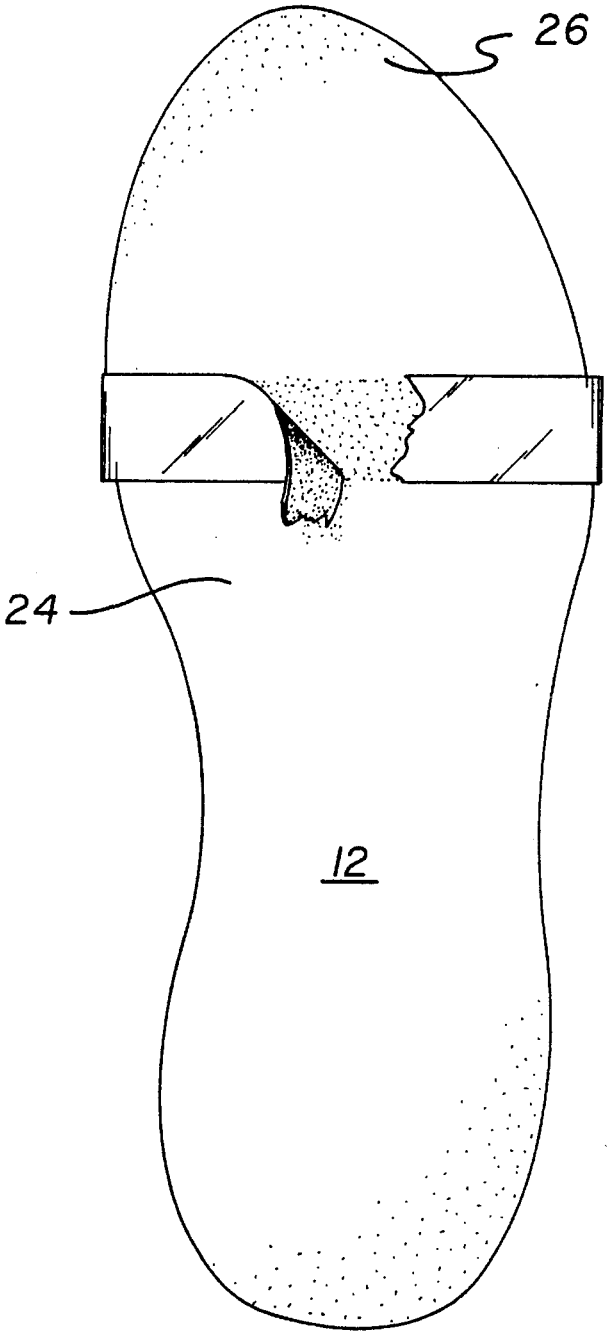
FIG. 3 is a bottom plan view of the present invention.
Figure 7:
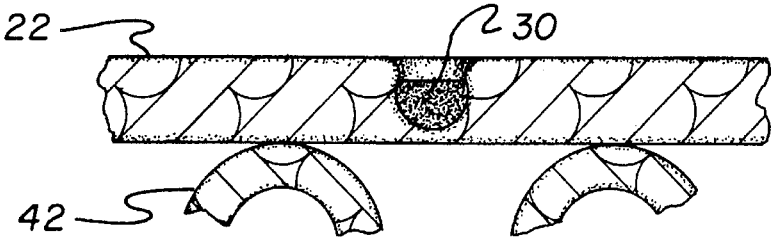
FIG. 7 is an enlarged fragmentary view of top surface of the present invention taken along line 7—7 of FIG. 5.

Specifically, the present invention includes a sole member 12 that has a front foot section 14, a heel section 16 and an instep section 18. The sections of the sole member follow the general contour of a human foot. The sole is made available in large and medium and small sizes, so as to accommodate the length and width of a variety of foot sizes. The sole member, as shown in FIG. 1, is formed of a flat planar paper material that has a top surface 22 and a bottom surface 24. Each surface of the sole has been coated with a water resistant material 26, that can be seen on FIGS. 1 and 3. The water resistant material makes the paper material of the sole member waterproof. The water resistant material may be a polymer film or a wax substance. Each surface of the sole has been impregnated with an anti-fungal agent 30, as shown in FIG. 7. The agent is commercially available and a non-skin irritant.

Figure 6:
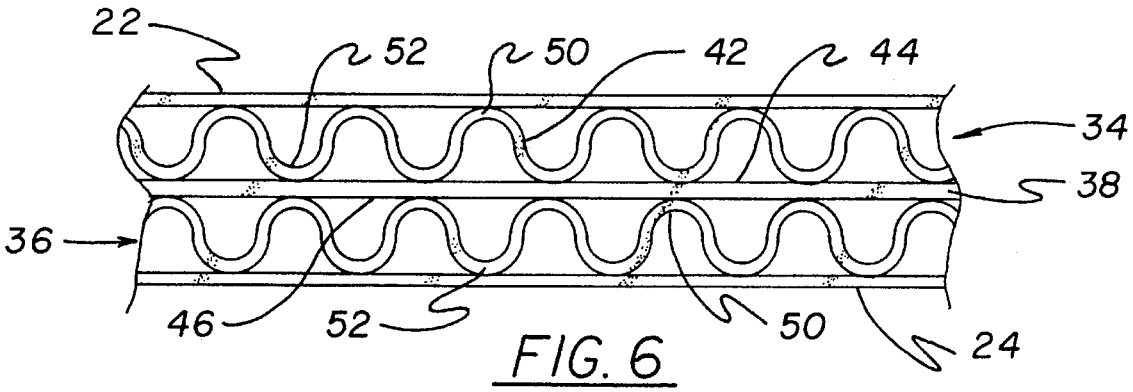
FIG. 6 is an enlarged cross sectional cut-away view of the paper material of the present invention taken at position 6 of FIG. 2.

As best illustrated in FIG. 6, the paper material of the sole member has a top layer 34 and a bottom layer 36 with a common sheeting 38. The paper material is formed from a high strength paper board. Each layer of the paper material is comprised of a corrugated paper sheet 42. The corrugated sheet provides a small layer of cushion between the foot and the shower floor. The corrugated paper sheet of the top layer is attached to an upper surface 44 of the common sheeting and the top surface 22 of the sole. The corrugated paper sheet of the bottom layer is attached to a bottom surface 46 of the common sheeting and the bottom surface of the sole.

Additionally, the corrugated sheet 42 of each layer has an alternating sequence of protruding crests 50 and recessed troughs 52 that define a wave-like filler, as shown in FIG. 6. The crests and troughs of each corrugated sheet of each layer extends laterally to left 54 and right 56 edges of the sole. The crests and recesses extend in a direction that is generally perpendicular with the longitudinal axis of the sole member. The filler of each layer is treated with the water resistant material 26 to make the filler of each layer waterproof. Each layer of the sole is juxtaposed within the wave-like filler of each layer and has a predetermined thickness. The crests and recessed troughs of each layer are adhesively attached to the respective surface of the sole. Finally, the crests are deformed with the first wearing of the sole and becomes non-functional thereafter.

Figure 2:
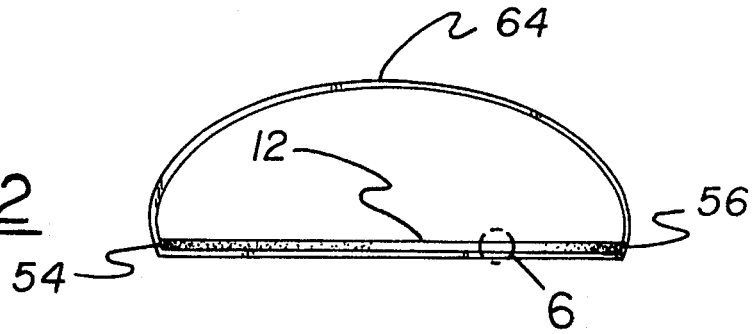
FIG. 2 is a fragmentary rear view of the present invention taken along line 2—2 of FIG. 1.
Figure 4:
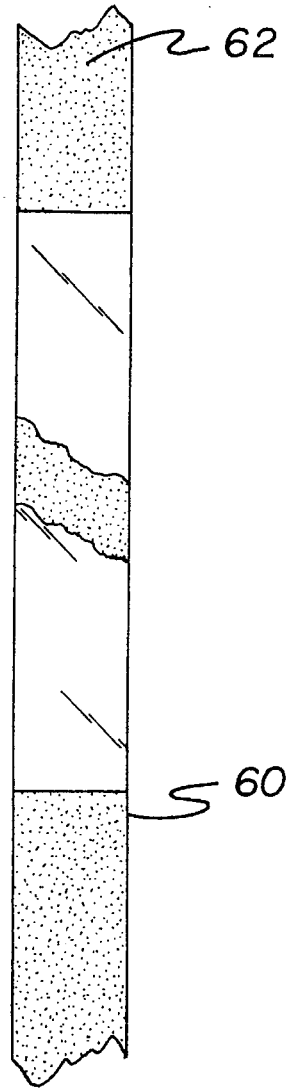
FIG. 4 is a fragmentary sectional view of the strap of the present invention.
Figure 5:
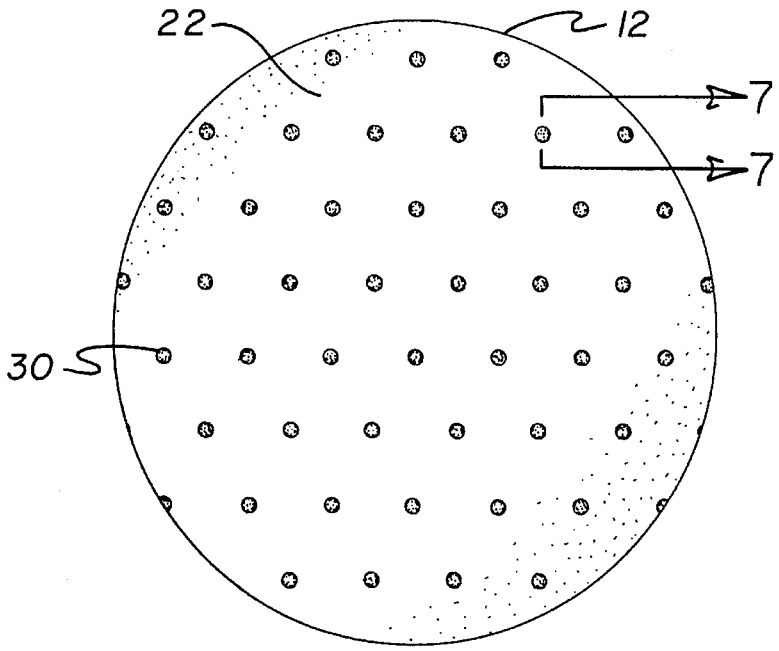
FIG. 5 is an enlarged view of the top surface of the present invention taken at position 5.

Lastly, an elongated strap 60 is formed of a double layer of flexible material such as high strength cellophane. The layers of the strap, as shown in FIG. 4, are attached thereto by an adhesive 62. The strap is positioned around the sole member 12 and forms a semi-spherical loop 64 above the top surface of the sole as shown in FIG. 2. The strap is attached by an identical adhesive to the bottom surface 24 of the sole between the instep section 18 and the front foot section 14. Furthermore, the sole member with the strap, is provided in pairs to a buyer. Drawings herein with this application show a disposable shower thong for the left foot. A disposable shower thong for the right foot will be a mirror image of that shown in the drawings with this application.

The present invention is a disposable shower thong for protection of feet from bacteria and fungi growing on shower surfaces, when worn in public or private showers. The thong is composed of a sole member that is made from a corrugated paper material and covered with a waterproofing material. Also, the sole member has been impregnated with an anti-fungal agent which guards against athletic's foot or other fungal condition. The thong of the present invention is lightweight and can be packed away in a suitcase for travel and used when on trips. Once the thong is used, it can be easily disposed of. The particular thong is a biodegradable thong which will not harm the environment like rubber or other plastics.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A disposable shower thong comprising:

a sole member being formed of a flat planar paper material having a top surface and a bottom surface, the paper material of the sole member having a top layer and a bottom layer with a common sheeting therebetween, each layer being comprised of a corrugated paper sheet, the corrugated sheet of each layer having an alternating sequence of protruding crests and recessed troughs defining a wave like filler, the sole member having a front foot section, a heel section and an instep section therebetween; and an elongated strap being positionable around the sole member and attached by an adhesive to the bottom surface of the sole, the strap when attached to the bottom surface forms a semi-spherical loop above the top surface of the sole.

2. The disposable shower thong as set forth in claim 1 wherein the top and bottom surface of the sole member having been coated with a water resistant material and impregnated with an anti-fungal agent, the water resistant material making the sole member water proof for shower wear.

3. The disposable shower thong as set forth in claim 1 wherein the crest of the corrugated paper sheet of the top layer being attached to the top surface of the sole and the recessed troughs being attached to an upper surface of the common sheeting.

4. The disposable shower thong as set forth in claim 3 wherein the crest of the corrugated paper sheet of the bottom layer being attached to a bottom surface of the common sheeting and the recessed troughs being attached to the bottom surface of the sole.

5. The disposable shower thong as set forth in claim 4 wherein the crests and troughs of each corrugated sheet of each layer extending laterally to the left and rights edges of the sole, and in a direction generally perpendicular with the longitudinal axis of the sole member, the filler of each layer being treated with the water resistant material for making the filler of each layer water proof.

6. The disposable shower thong as set forth in claim 1 wherein the strap being formed of a double layer of flexible material where the layers of the strap being attached thereto by an adhesive, with the identical adhesive being used to attach the strap to the bottom surface of the sole, and the strap being positioned between the instep section and the front foot section.

7. A new and improved disposable shower thong for protection of feet from bacteria and fungi growing on shower surfaces comprising in combination:

a sole member having a front foot section, a heel section and an instep section therebetween, the sole being formed of a flat planar paper material having a top surface and a bottom surface, each surface of the sole having been coated with a water resistant material for making the paper material of the sole member water proof, each surface of the sole being impregnated with an anti-fungal agent;

the paper material of the sole member having a top layer and a bottom layer with a common sheeting therebetween, each layer being comprised of a corrugated paper sheet, the corrugated paper sheet of the top layer being attached to an upper surface of the common sheeting and the top surface of the sole, the corrugated paper sheet of the bottom layer being attached to a bottom surface of the common sheeting and the bottom surface of the sole;

the corrugated sheet of each layer having an alternating sequence of protruding crests and recessed troughs defining a wave like filler, the crests and troughs of each corrugated sheet of each layer extending laterally to left and right edges of the sole, and in a direction generally perpendicular with the longitudinal axis of the sole member, the filler of each layer being treated with the water resistant material for making the filler of each layer water proof; and an elongated strap being formed of a double layer of flexible material, the layers of the strap being attached thereto by an adhesive, the strap being positionable around the sole member and forming a semi-spherical loop positionable above the top surface of the sole, the strap being attached by an adhesive to the bottom surface of the sole between the instep section and the front foot section.

* * * * *